US005520283A

United States Patent [19]

Sutherland

[11] Patent Number: 5,520,283

[45] Date of Patent: May 28, 1996

[54] WARP-AROUND CARRIER WITH ARTICLE RETAINING FLAPS

[75] Inventor: Robert L. Sutherland, Kennesaw, Ga.

[73] Assignee: Riverwood International Corporation, Atlanta, Ga.

[21] Appl. No.: 280,902

[22] Filed: Jul. 27, 1994

[51] Int. Cl.[6] ..... B65D 75/00

[52] U.S. Cl. ..... 206/434; 206/140; 206/152; 206/427

[58] Field of Search ..... 206/140, 147, 206/152, 155, 427, 429, 434

[56] References Cited

U.S. PATENT DOCUMENTS

| | | | |
|---|---|---|---|
| 3,229,892 | 1/1966 | Weiss | 206/152 |
| 3,367,557 | 2/1968 | Farquhar | 206/434 |
| 3,517,876 | 6/1970 | Stout | 206/434 |
| 4,355,717 | 10/1982 | Oliff | 206/140 |
| 4,533,047 | 8/1985 | Calvert | 206/434 |
| 4,545,485 | 10/1985 | Oliff | 206/147 |
| 5,094,347 | 3/1992 | Schuster | 206/140 |

*Primary Examiner*—David T. Fidei

[57] ABSTRACT

A wrap-around carrier for packaging curved articles, such as beverage bottles or cans. Inwardly folded retaining flaps are connected to the side edges of apertures through which the lower portions of the articles protrude. The fold lines of the flaps are arranged to create a bias tending to maintain pressure on the articles to prevent movement within the carrier. In one embodiment the entire flap engages the side of an adjacent article. In another embodiment only upper flap segments engage the article sides, while lower segments are located between the bottom of the adjacent article and the bottom panel of the carrier.

5 Claims, 3 Drawing Sheets

WARP-AROUND CARRIER WITH ARTICLE RETAINING FLAPS

FIELD OF THE INVENTION

This invention relates to wrap-around carriers which contain heel cutouts or apertures for holding the bottom portions of adjacent rounded articles in place. More particularly, it relates to a wrap-around carrier provided with additional retaining means for securing the articles in the carrier.

BACKGROUND OF THE INVENTION

Wrap-around carriers are tightly drawn about the articles to be packaged in order to prevent the articles from moving toward the open ends of the carrier during shipment and handling. To further ensure a secure package, carriers designed to accommodate beverage bottles are normally provided with cutouts in the side panels which allow the bottom or heel portion of the bottles to extend out beyond the side panel. As a result, the bottles are better held in place by the bite between their bottom portions and the side edges of the cutouts. Despite the success of such carriers it is desirable to provide even greater restriction to bottle movement, especially in wrap-around carriers used for packaging relatively large bottles or bottles whose bottom portions are not of a constant diameter.

One approach to further restricting bottle movement in a wrap-around carrier is disclosed in U.S. Pat. No. 4,533,047, which is directed to the use of a particular type of retaining flap connected to the end cutout edges. When folded in as the wrapper is applied, the flaps engage the heels of the bottles at the ends of the carrier. The flaps are of highly specialized design, restricted to carriers having sloped heel panels and required to extend up into the side panel in such a manner as to preclude the provision of side panel tabs. Such tabs, which conventionally extend down to the top of the heel cutouts, exert inward pressure against the bottles to assist in securely maintaining the bottles in place.

A main object of this invention, therefore, is to provide a wrap-around carrier having improved article retaining flaps which are not restricted in the manner of the prior art retaining flaps.

BRIEF SUMMARY OF THE INVENTION

The wrap-around carrier of the invention, which has been designed to package articles having curved lower side portions, comprises opposite side panels foldably connected to top and bottom panels in conventional manner. The carrier includes apertures located opposite the lower side portions of adjacent articles, each aperture having opposite edges defined at least partially by fold lines connected to an inwardly folded retaining flap. The fold lines of each edge intersect at a point, and each retaining flap includes a transverse fold line extending across the flap from that point to divide the flap into upper and lower segments. At least the upper segment of each retaining flap contacts the lower side portion of an associated article. The carrier also includes fold lines extending transversely from each of the points of intersection, the fold lines lying in a plane substantially parallel to the bottom panel. Preferably, the lower edge portion of tabs extending down from the side panels defines the upper edge of an aperture. The bottom portions of the articles protrude through the apertures and are maintained in place partially by the retaining flaps. The retaining flaps are biased toward the articles by the angled intersecting fold lines connecting them to the carrier.

In one embodiment both the upper and lower retaining flap segments contact the lower side portion of an associated article, and the fold lines which lie in a plane substantially parallel to the bottom panel connect the side panels to beveled heel panels. In another embodiment the side panels are connected directly to the bottom panel and only the upper retaining flap segments contact the lower side portions of the articles, the lower retaining flap segments being located between the bottom of an associated article and the bottom panel.

The carrier of the invention reliably prevents outward movement of packaged curved articles, and does so in an improved, efficient manner.

The above and other aspects and benefits of the invention will readily be apparent from the more detailed description of the preferred embodiments of the invention which follows.

DETAILED DESCRIPTION OF THE PREFERRED EMBODIMENTS

Figure 1:
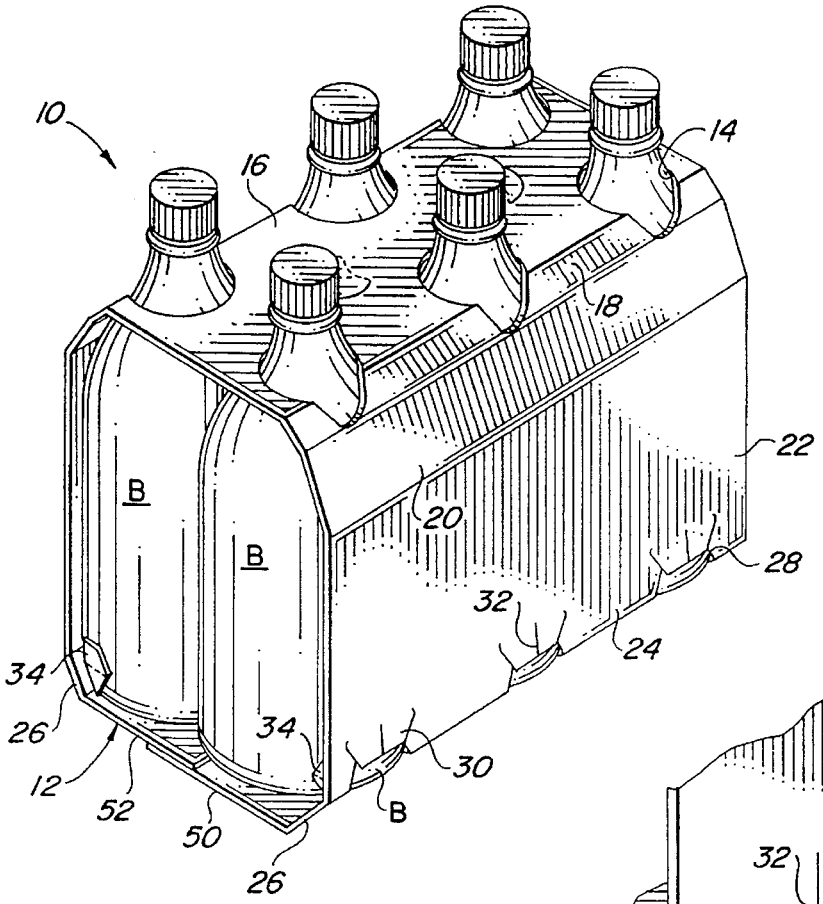
FIG. 1 is a pictorial view of one embodiment of the wrap-around carrier of the invention.

Referring to FIG. 1, the wrap-around carrier 10 is illustrated in connection with six beverage bottles B supported on bottom panel 12. The necks of the bottles extend up through openings 14 in both top panel 16 and short sloped shoulder panels 18. Longer sloped shoulder panels 20 extend from the shoulder panels 18 and are connected to vertical side panels 22. Although the sloped shoulder panels enable the carrier wrapper to more closely follow the contour of the upper portion of the illustrated bottles, they are not directly related to the invention and may or may not be present depending on the shape of the packaged articles. The side panels 22 are connected at their lower end to short sloped heel panels 26 which are connected to the bottom panel 12. Cutouts 28 in the side and heel panels receive protruding heel portions of the bottles. Tabs 30, which include vertical slits 32 in their lower edge portions, extend down from the side panels 22 and contact the outer heel portions of the bottles.

Figure 3:
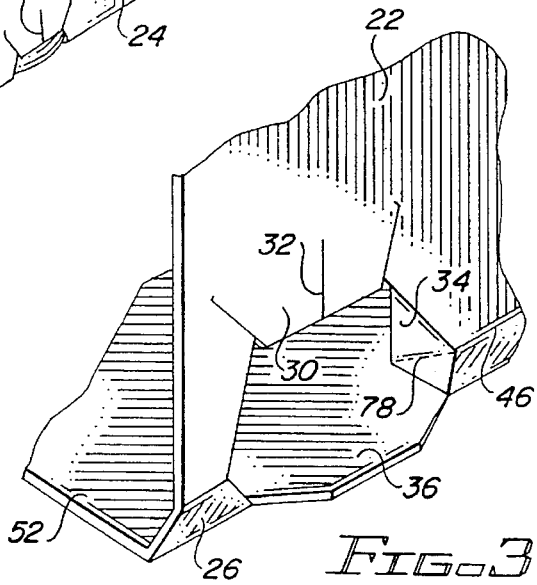
FIG. 3 is an enlarged partial pictorial view of an end of the carrier of FIG. 1, with the end bottle omitted for clarity.
Figure 2:
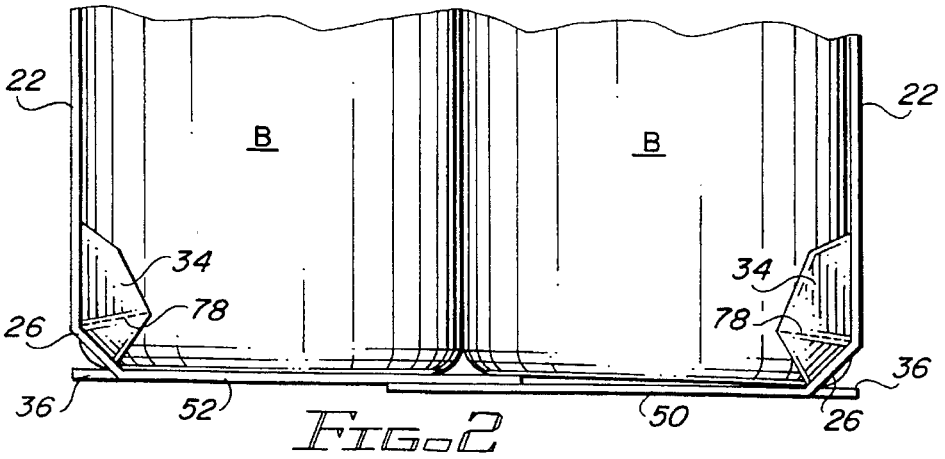
FIG. 2 is an enlarged partial end view of the carrier of FIG. 1.

As shown in FIGS. 1 and 2, retaining flaps 34 extend inwardly from the outer side edge of the end cutouts and are in contact with the heel portion of the adjacent bottle. Similar retaining flaps extend back from opposite side edges of all the cutouts, as illustrated in FIG. 3, which does not show the associated bottle in order to expose the inner flap to view. Due to the foldable connections between the flaps and the cutout edges, which are described in more detail below, the flaps are biased toward the bottles so as to maintain continuous contact with the bottles. As can be seen in FIG. 2, the bottom of the protruding portion of the bottles rests on an extension 36 of the bottom panel.

Figure 4:
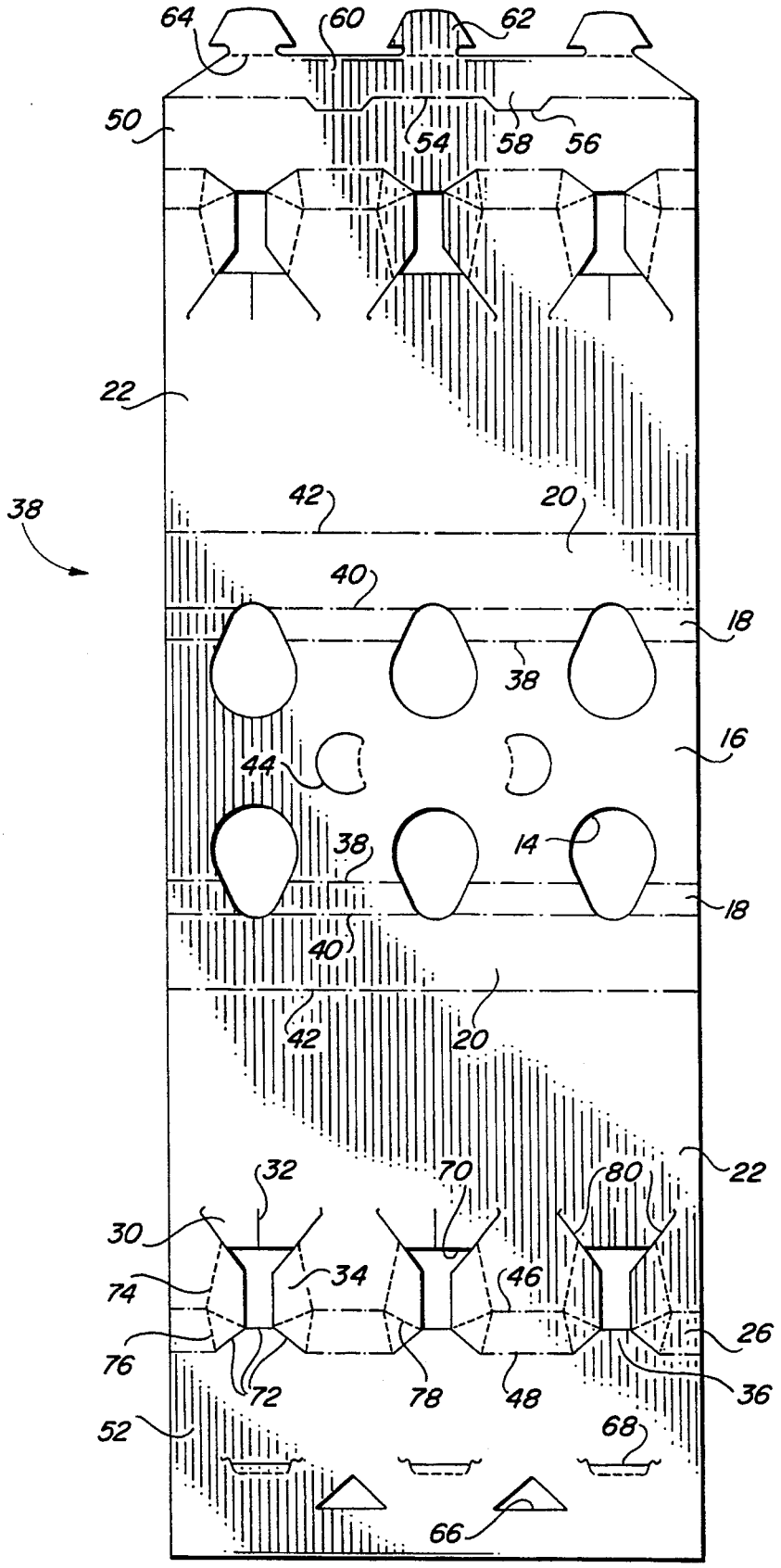
FIG. 4 is a plan view of a blank for forming the carrier of FIG. 1.

Referring now to FIG. 4, wherein like reference numerals to those used in FIGS. 1, 2 and 3 denote like elements, a blank 38 capable of being fabricated into the carrier of FIG. 1 is comprised of a central top panel section 16 connected at opposite sides by fold lines 38 to the short shoulder panel sections 18. Fold lines 40 connect the panel sections 18 to the longer shoulder panel sections 20, which in turn are connected to the side panel sections 22 by fold lines 42. The top panel section includes finger holes 44 for lifting the carrier. If the articles to be packaged do not have necks or are otherwise shaped so as not to extend through the top panel, the openings 14 would of course not be provided.

Interrupted fold lines 46 connect the side panel sections 22 to the heel panel sections 26, while interrupted fold lines 48 connect the heel panel sections 26 to bottom panel flaps 50 and 52. The fold lines 46 and 48 are parallel to each other. Included in the bottom panel flap 50 is a fold line 54 which extends the full length of the flap and which is interrupted by slits 56 forming primary male locking tabs 58. The portion 60 of the flap 50 lying outwardly of the fold line 54 constitutes a locking panel which includes secondary male locking tabs 62 connected to the locking panel by fold lines 64. Incorporated in the bottom panel flap 52 are cutouts 66, which include primary female locking edges for engaging the primary male locking members 58, and slits 68 adapted to receive the secondary locking tabs 62. These various locking elements are illustrated to demonstrate a typical bottom panel locking arrangement suitable for use with the carrier of the invention, but it should be understood that any desired effective form of bottom panel locking means may be employed.

Still referring to FIG. 4, each heel cutout comprises an aperture defined at the top by the edge 70 of the associated tab 30, at the bottom by the edge 72 of the associated bottom panel extension 36 and at the sides by the fold lines 74 and 76 connecting the associated retaining flaps 34 to the blank. The fold lines 74 of each pair of flaps extend along diverging paths to the point of intersection with the fold line 46, and the fold lines 76 extend along converging paths from that point to their point of intersection with the fold line 48. An additional fold line 78 in the body of each retaining flap extends from the intersection of the fold lines 74 and 76 to a point on the edge 72.

A package is formed from the carrier blank by grouping the bottles as they are to be arranged in the package and then placing the top panel section 16 of the blank on top of the bottles, with the necks of the bottles extending through the bottle neck openings 14. While the blank is being folded down, the retaining flaps 34 are folded in so that each pair of flaps is positioned on opposite sides of an associated bottle. The blank is then pulled tightly around the bottles, and the bottom panel flaps are locked together by the locking tabs to form the bottom panel 12. Because the flaps are folded about the angled fold lines 74 and 76, a bias is created tending to return the flaps to their original position. This causes the flaps to maintain a steady pressure against an adjacent bottle, assisting to hold the bottle in place. The internal fold line 78 takes up the stresses in the flaps which would otherwise cause the flaps to buckle as they are folded in against the bias of the fold lines 74 and 76.

As can be seen in FIGS. 1, 3 and 4, the slits 80 forming the side edges of the tabs 30 extend up into the side panel section 22, allowing the tabs to be pushed out to an extent, against the bias tending to keep them in the plane of the side panel, by an associated bottle. The slits 32 divide the tabs in two, facilitating such tab movement. The tabs 30 thus also exert an inward force against the bottles to help maintain them in place in the carrier. Because the design permits similar retaining flaps to be provided at opposite edges of each heel cutout, each bottle in the carrier is subjected to equal amounts of retaining forces on both sides.

Figure 5:
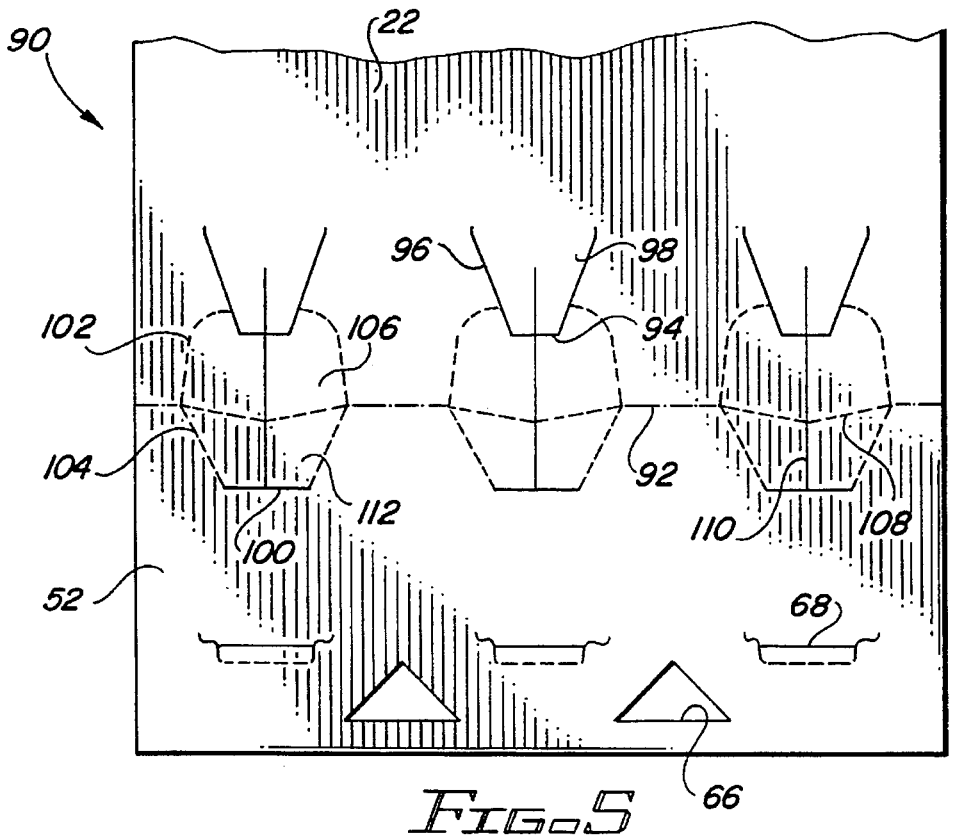
FIG. 5 is a partial plan view of a blank for forming a modified carrier.

One end portion of a modified carrier blank 90 is shown in FIG. 5. It will be understood that the heel cutout design of the other end portion of the blank is similar to that shown. In this design there is no sloped heel panel section, resulting in the side panel section 22 being connected directly to the bottom panel flap 52 by interrupted fold line 92. The heel cutouts in this arrangement are defined by the end edges 94 and portions of the side edges 96 of the associated tab 98, by the edge portion of the bottom panel flap formed by the slit 100, and by the edges formed by the fold lines 102 and 104 connecting the associated retaining flaps 106 to the blank. The fold lines 102 of each pair of flaps extend along diverging paths to the point of intersection with the fold line 92 and the fold lines 104 extend along converging paths from that point to the adjacent end of the slit 100. As in the first embodiment an additional fold line 108 in the body of each retaining flap extends across the flap from the intersection of the fold lines 102 and 104. The flaps of each pair include an edge formed by the slit 110 extending up from the slit 100 to the edge 94 of the tab 98.

Figure 6:
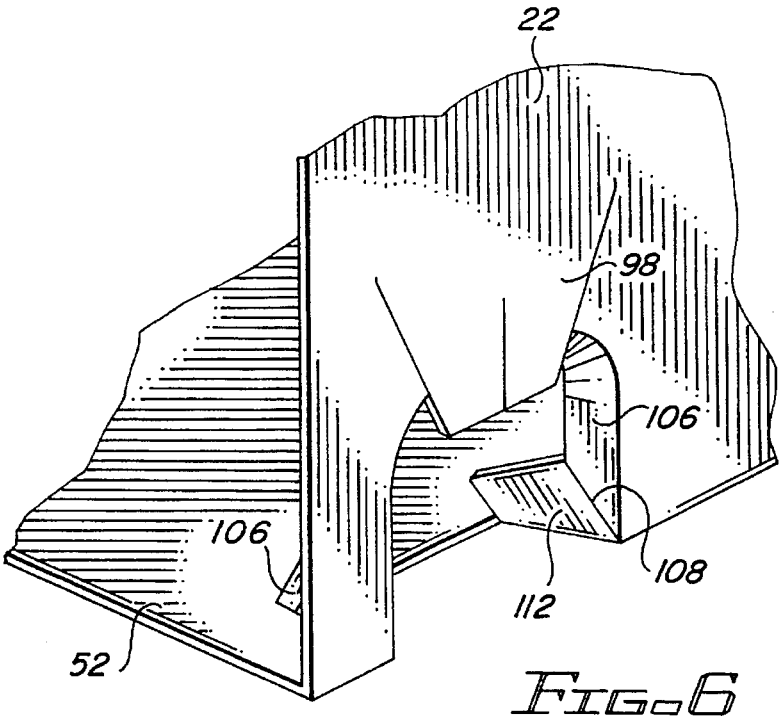
FIG. 6 is an enlarged partial pictorial view of an end of a carrier formed from the blank of FIG. 5.

A carrier is formed from the blank 90 in the same manner as described in connection with the first embodiment. In this case, however, as the retaining flaps 106 are folded in about their fold lines 102 and 104 the portion of the flaps between the fold lines 108 and the slits 110, designated by reference numeral 112, moves to a position flat against the bottom panel flap 52. This arrangement is illustrated in FIG. 6. As this hinged movement of the flaps takes place, the flap segments 112 move below the adjacent bottle, so that the bottle rests on these segments as well as on the bottom panel. The weight of the bottle on the segments 112 holds the retaining flaps in their biased position secure against forces which might tend to move the side flap portions away from the bottles. Note in FIG. 5 that the length of the retaining flap segment 112 is maximized by separating the segments in the blank only by the slit 110. It is desirable to maximize the length in order to provide maximum flap area beneath the associated bottle. In addition, the fold line 104 has been made quite long by extending the cutout well into the bottom panel flap 52, thereby further strengthening this critical fold.

The carrier should be formed of a material which is sufficiently flexible to permit folding into final form and to provide the biasing properties required of the flap fold lines. Paperboard of the type typically employed in the carrier industry is the preferred choice, since it is economical, readily foldable, and its fibrous nature causes the retaining flap fold lines to be sufficiently biased toward the interior of the package.

It should now be apparent that the invention provides improved article retaining means in a wrap-around carrier in an economical efficient manner. Because the retaining flaps greatly improve the ability of wrap-around carriers to prevent movement of packaged bottles toward the ends of a carrier, carriers can now be formed from blanks of less caliper or thickness than was previously found necessary. In addition, the invention is especially useful in packaging so-called "petaloid" bottles. The shape of such bottles, which are formed of plastic and have support feet spaced about the periphery of the heel, makes it difficult to be gripped by the edges of conventional heel cutouts. The flexible retaining flaps of the invention exert pressure against petaloid bottles regardless of the orientation of the petaloid feet with respect to the edges of the heel cutouts, and so are able to hold such bottles in place.

Although described primarily in connection with the packaging of beverage bottles, it will be appreciated that other articles, such as cans, can also be packaged in carriers incorporating the features of the invention. Further, it is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A wrap-around carrier containing a plurality of articles, each article having a bottom and a curved lower side portion adjacent the bottom, comprising:

opposite side panels foldably connected to a top panel;

a bottom panel;

opposite bevel panels foldably connected to the bottom panel and to the side panels;

each side panel including an aperture located opposite the lower side portion of each of the articles, each aperture extending into an associated bevel panel;

each aperture having opposite edges, each edge being defined at least partially by converging fold lines connecting an inwardly folded retaining flap to the carrier, one of the converging fold lines of each aperture edge connecting the associated retaining flap to the associated side panel and the other converging fold line connecting the associated retaining flap to the associated bevel panel, the converging fold lines of each edge intersecting at a point on the foldable connection between the associated side panel and the associated bevel panel; and each retaining flap having a transverse fold line extending across the flap from said point of intersection and dividing the flap into upper and lower segments, both the upper and lower segments of each retaining flap contacting the lower side portion of an associated article.

2. A wrap-around carrier as defined in claim 1, including a tab associated with each aperture, the tab extending down from the associated side panel and having a lower edge portion defining an upper edge portion of the associated aperture.

3. A wrap-around carrier as defined in claim 1, wherein the bottom panel extends outwardly of the bevel panels at each aperture.

4. A substantially rectangular blank for forming a wrap-around carrier for use in packaging articles having a bottom and curved lower side portions adjacent the article bottom, comprising:

a centrally located top panel section;

side panel sections connected to opposite sides of the top panel section along fold lines;

a bevel panel section connected to each side panel section along a fold line;

a bottom panel flap connected to each bevel panel section along a fold line;

the side panel sections including a plurality of apertures, each aperture extending into the associated bevel panel section and being located opposite the intended location of the lower side portion of an article in a carrier formed from the blank;

each aperture having opposite edges, each edge being defined at least partially by converging fold lines connecting a retaining flap to the blank, one of the converging fold lines of each aperture edge connecting the associated retaining flap to the associated side panel section and the other converging fold line connecting the associated retaining flap to the associated bevel panel section, the converging fold lines of each edge intersecting at a point on the fold line connecting the associated side panel section to the associated bevel panel section;

each retaining flap having a transverse fold line extending across the flap from said point of intersection and dividing the flap into upper and lower segments;

the upper and lower segments of each retaining flap, when folded inwardly in a carrier formed from the blank, contacting the lower side portion of an associated article.

5. A blank as defined in claim 4, including a tab associated with each aperture, the tab extending from the associated side panel section and having a lower edge portion defining an upper edge portion of the associated aperture.

* * * * *